US010539142B2

(12) United States Patent
Blad

(10) Patent No.: US 10,539,142 B2
(45) Date of Patent: Jan. 21, 2020

(54) ROTARY PUMP WITH AXIALLY DISPLACEABLE, CLOSEABLE ROTOR

(71) Applicant: GRUNDFOS HOLDING A/S, Bjerringbro (DK)

(72) Inventor: Thomas Blad, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 901 days.

(21) Appl. No.: 14/392,246

(22) PCT Filed: Jun. 25, 2014

(86) PCT No.: PCT/EP2014/063370
§ 371 (c)(1),
(2) Date: Dec. 24, 2015

(87) PCT Pub. No.: WO2014/207030
PCT Pub. Date: Dec. 31, 2014

(65) Prior Publication Data

US 2016/0273542 A1 Sep. 22, 2016

(30) Foreign Application Priority Data

Jun. 27, 2013 (EP) ..... 13174142

(51) Int. Cl.
*F04D 29/042* (2006.01)
*F04D 13/06* (2006.01)
(Continued)

(52) U.S. Cl.
CPC ..... *F04D 29/042* (2013.01); *F04D 13/064* (2013.01); *F04D 15/0022* (2013.01); *F04D 29/426* (2013.01)

(58) Field of Classification Search
CPC .. F04D 29/042; F04D 29/426; F04D 29/0416; F04D 15/0038; F04D 15/0022; F04D 1/00; F04D 13/064; F04D 13/024
See application file for complete search history.

(56) References Cited

U.S. PATENT DOCUMENTS 2,265,806 A 12/1941 Goldschmied
3,329,095 A * 7/1967 Bartels ..... F04D 29/042 415/131
6,229,240 B1 * 5/2001 Kech ..... H02K 3/47 242/433

FOREIGN PATENT DOCUMENTS

DE 21 07 000 A1 8/1972
DE 25 10 787 A1 9/1976
(Continued)

*Primary Examiner* — Dwayne J White
*Assistant Examiner* — Danielle M. Christensen
(74) *Attorney, Agent, or Firm* — McGlew and Tuttle, P.C.

(57) ABSTRACT

A centrifugal pump assembly has an electric drive motor (2) and at least one impeller (10; 10'), which is movable in an axial direction (X) between at least two functional positions. In one functional position a flow path through the impeller (10; 10') is essentially closed and in another functional position the flow path through the impeller (10; 10') is opened. The impeller (10; 10') in a first functional position is held by a magnetic force ($F_M$) or a spring force and in a second functional position is held by a hydraulic force ($F_H$) produced by a delivered fluid. An impeller is provided for the centrifugal pump assembly.

20 Claims, 4 Drawing Sheets

(51) Int. Cl.
*F04D 15/00* (2006.01)
*F04D 29/42* (2006.01)

(56) References Cited

FOREIGN PATENT DOCUMENTS

| | | | |
|---|---|---|---|
| DE | 93 19 309 | U1 | 8/1995 |
| DE | 195 23 661 | A1 | 1/1997 |
| DE | 101 15 989 | A1 | 12/2001 |
| DE | 10 2010 062752 | A1 | 6/2012 |
| EP | 2 228 891 | A2 | 9/2010 |

* cited by examiner

ROTARY PUMP WITH AXIALLY DISPLACEABLE, CLOSEABLE ROTOR

CROSS REFERENCE TO RELATED APPLICATIONS

This application is a United States National Phase Application of International Application PCT/EP2014/063370 filed Jun. 25, 2014 and claims the benefit of priority under 35 U.S.C. § 119 of European Patent Application 13174142.3 filed Jun. 27, 2013, the entire contents of which are incorporated herein by reference.

FIELD OF THE INVENTION

The invention relates to a centrifugal pump assembly, as well as to an impeller for such a centrifugal pump assembly.

BACKGROUND OF THE INVENTION

Centrifugal pump assemblies are known, which comprise an axially displaceable shaft, by which means the impeller can be brought into two axial positions, wherein in a first position the flow path through the impeller is closed and in a second position the flow path through the impeller is opened. Such an arrangement is known for example from DE 101 15 989 A1. In the first position, in which the flow path through the impeller is closed, the impeller is held by a spring force, whilst given a drive motor subjected to current, it is pulled against the spring force by a magnetic force which then results, into the second position. I.e., in order to open the impeller and the pump, it is necessary for the drive motor to have a particular design which produces a magnetic axial force for moving the impeller when subjected to current.

SUMMARY OF THE INVENTION

It is an object of the invention to provide a centrifugal pump assembly which permits a displacement of the impeller between a first and a second functional position, without a magnetic axial force produced by way of subjecting the drive motor to current.

The centrifugal pump assembly according to the invention comprises an electric drive motor which is preferably designed as a permanent magnet rotor. Preferably, with regard to the drive motor, it is the case of a canned motor, i.e. a wet-running motor. The drive motor drives at least one impeller. Thereby, the impeller can be connected via a shaft to the rotor of the drive motor. Alternatively, it is possible for the impeller to also be connected directly to a rotor which is designed without a shaft, or to be formed as one piece with at least a part of the rotor. According to the invention, the impeller can be moved in the axial direction between at least two functional positions. Thereby, the movement of the impeller is preferably effected together with the shaft or the rotor of the electric drive motor. In a first functional position, a flow path through the impeller is essentially closed, so that the impeller in this functional position can assume a valve function and can essentially block a flow path through the centrifugal pump assembly. The blocking essentially means that a small residual passage can still remain, and is even desirable as the case may be, as will be explained hereinafter. In another functional position, in which the impeller is axially displaced, in contrast, the flow path through the impeller and thus through the centrifugal pump assembly is opened and the centrifugal pump assembly can deliver a fluid, in particular a liquid, given a drive of the electrical drive motor, by way of rotation of the at least one impeller.

According to the invention, the impeller in a first functional position is held by a magnetic force, in particular a permanent magnetic force or a spring force. Then, according to the invention, the impeller can be moved from the first into the second functional position by way of a hydraulic force and also be held in the second position by a hydraulic force. This hydraulic force is a hydraulic force which is produced by a fluid delivered by the impeller. I.e. the impeller, if it is driven by the drive motor, produces a pressure at the exit side, which in turn acts on the impeller and/or a component coupled to the impeller for force transmission, such that a hydraulic force acts on the impeller holding it in the second functional position. Thus, the impeller can be moved axially for opening the flow passage in a very simple manner by way of activating the drive motor, i.e. by starting operation of the drive motor.

Particularly preferably, the impeller is held in the first functional position by way of a permanent-magnetic force which in particular acts between a permanent magnet rotor connected to the impeller and the surrounding stator of the drive motor. One can thus make do without additional components for producing a permanent-magnetic force. Moreover, these force production means are essentially without any wear, so that a high reliability of the pump assembly according to the invention is ensured. Particularly preferably, the impeller is held in the first functional position by a permanent magnetic force which results from the axial shifting of the permanent magnet rotor relative to the stator of the drive motor. A permanent magnetic rotor in the axial direction strives to center itself in the axial direction in the magnetic circuit of the stator. If the rotor is then moved in the axial direction out of this centered position, this leads to a permanent magnetic restoring force which strives to pull the rotor back into the centered position. This permanent magnetic restoring force according to the invention is used in order to hold the impeller in the first functional position, and as the case may be to move it out of the second functional position into the first functional position, if the hydraulic force holding the impeller in the second functional position falls off. I.e. with this design, the centrifugal pump assembly is designed such that the hydraulic force which holds the impeller in the second functional position is larger than the permanent magnetic force which holds the impeller in the first functional position. This then leads to the hydraulic force dropping away when switching off the drive motor, and the impeller being moved by the permanent magnetic force back into the first functional position. If the drive motor is switched on, the impeller at the exit side produces a pressure, and the mentioned hydraulic axial force is built up, which is greater than the permanent magnetic restoring force, so that the impeller is then moved out of the first functional position into the second functional position.

Particularly preferably, the flow path through the impeller is closed in the first functional position and is open in the second functional position. Alternatively however, a reverse arrangement is also possible, with which the flow path through the impeller is closed in the second functional position and is opened in the first functional position. In the first functional position, the impeller is moreover preferably situated closer to the stator than in the second functional position. The impeller in the second functional position is preferably moved further towards the suction side than in the first functional position. Here too, a reverse design is also possible.

A closure element is further preferably present and in that functional position, in which the flow path through the impeller is closed, this closure element closes an exit opening or entry opening of the impeller at least to a greater extent, preferably by more than 90%. Thus, the closure of the flow path is achieved by the closure element, wherein as is described above, it is possible for a residual opening to remain in the flow path, said residual opening permitting a flow on starting up the impeller in the closed or blocked functional position, in order to ensure a pressure build-up at the exit side of the impeller even in this functional position, in order to produce the desired hydraulic force for displacing the impeller into the second functional position. Such a residual opening is preferably smaller than 10% of the entire flow path, further preferably smaller that 5% or 2% of the entire flow path. Such a residual opening however is tolerable with many applications, with which a blocking of the flow path is desired. Further preferably, the centrifugal pump assembly is designed in a manner such that the closure element in that functional position, in which the flow path through the impeller is essentially closed, closes the entry opening or the exit opening for the greater part, but only to the extent that a pressure build-up at the exit side of the impeller is possible on starting up the impeller. I.e. the residual opening of the impeller is preferably as small as possible, but as large as is necessary for the pressure build up in the closed condition.

The impeller is preferably movable between the first and the second functional position relative to the closure element, in order to permit an opening and closure of the flow path by way of the closure element. Thereby, the closure element is preferably stationary, and the impeller is axially displaceable, as described. The closure element can preferably surround the impeller on the peripheral side, and the impeller with its outer wall immerses into the inner periphery of the closure element.

According to a further preferred embodiment of the invention, the impeller can comprise an axial-side or radial-side entry opening, and the closure element in one functional position can essentially cover the entry opening, in order to effect the closure of the flow path through the impeller, wherein, as described above, a certain residual opening, preferably smaller than 10% or 5%, further preferably smaller than 2% can remain. If the entry opening is situated on the axial side, the closure element is preferably aligned such that it extends transversely to the longitudinal axis or rotation axis of the impeller and closes the entry opening at the face side. In the case that the entry opening is situated on the radial side, preferably as an annular entry opening extending over the outer periphery of the impeller, the closure element is then preferably designed as an annular wall which can cover the impeller at the outer periphery.

According to a further possible embodiment, the impeller can comprise a radial-side exit opening, and the closure element can cover the exit opening in one functional position. I.e., with this embodiment, the centrifugal pump assembly is designed such that the flow path through the impeller is effected by way of closure of the radial-side or peripheral-side exit opening. The closure element thereby is preferably designed as an annular wall which in one functional position, i.e. the functional position in which the flow path is essentially closed, peripherally surrounds the exit opening. Thereby, a residual opening can also remain in the manner described above.

According to a further preferred embodiment, the centrifugal pump assembly is designed in a manner such that in a functional position, in which the flow path is closed by the impeller, the impeller bears with a peripheral edge delimiting the exit opening, on a face edge of the annular wall. Thus, the flow path between the first peripheral edge which preferably faces the other functional position and annular wall can be closed in an essentially tight manner. Further preferably however, a flow passage which is open to an axial face side of the impeller can remain between a second peripheral edge lying opposite this first peripheral edge, and the annular wall, in that functional position, in which the flow path through the impeller is essentially closed. This is preferably a pressure-side, axial face side on the outer side of the impeller. Further preferably, this axial face side is preferably situated in a space which is encompassed by the annular wall and which is completely closed to a pressure channel, when the impeller with its first face edge delimiting the exit opening bears on the annular wall. A flow path to the outside is completely interrupted in this manner. A flow path out of the exit side of the impeller to a pressure-side face side however remains, so that a pressure can build up in this region on rotation of the impeller, said pressure acting on the face side of the impeller and thus producing a hydraulic force which displaces the impeller out of this functional position into the other functional position, as the case may be against an acting permanent-magnetic force or spring force.

The subject matter of the invention is moreover an impeller for a centrifugal pump assembly. This impeller can in particular be applied in a centrifugal pump assembly as has been previously described, but could also be applied independently in another centrifugal pump assembly. The impeller comprises at least one exit opening and an entry opening. The feature essential to the invention is that the exit opening is not situated on the axial side but in a peripheral section of the impeller, i.e. is open to the outer periphery or radial side. Such an impeller permits the valve function described above, but could however not only be applied only for closing the flow path, but for example also for changing or switching between two possible flow paths by way of axial displacement, or for effecting a mixed function.

Particularly preferably, this impeller according to the invention comprises a closed, suction-side, axial face side, to which the peripheral section with the entry opening is adjacent. I.e. the fluid to be delivered essentially does not flow in the axial direction but essentially in the radial direction through the entry opening into the impeller. The closed, axial-side face side on the suction side of the impeller can simultaneously assume the function of a cam disk, by way of different hydraulic pressures acting on both sides of this face side, i.e. on the one hand on the inner side of the impeller and on the other hand on the distant outer side of the impeller. These hydraulic forces can be used for axial positioning or displacement of the impeller, depending on which side of the impeller a greater force acts. The closed, axial face side can be designed as one piece or in a single-part manner with the further parts of the impeller. However, it is also possible to design this closed side in the form of a separate disk which is fixed directly on the shaft of the rotor, as well as the impeller. Such a disk can be arranged axially distanced to the impeller so that a gap remains between the disk and the suction-side axial end of the impeller, said gap forming the annular, radial-side entry opening. Thus, an impeller according to the invention which comprises an entry opening open to the outer periphery can be created with a conventional impeller with an axial exit opening and an additional element, specifically the disk.

According to a further preferred embodiment, the entry opening is designed as an annular opening extending over the whole periphery of the impeller. Thereby, as the case may be, webs can be formed in the opening in the axial direction and connect the peripheral edges delimiting the opening, to one another, in order to stabilise the structure of the impeller. Alternatively or additionally for example, a closed axial face side of the impeller can also be connected to the remaining parts of the impeller via the shaft or a connection element in the inside of the impeller, in order to ensure a connection past the annular opening. The described opening preferably has an area which corresponds to 50 to 150% of the cross-sectional area in the inside of the impeller in this region, wherein this cross-sectional area extends transversely to the longitudinal axis or rotation axis of the impeller. The opening of the impeller is preferably selected so large that flow speeds which are too high do not occur in this region.

Further preferably, the impeller on a suction side comprises an lengthened cylindrical section with a constant cross section which preferably has an outer area which corresponds to a magnitude of 50 to 150% of an inner cross section (transverse to the longitudinal axis of the impeller) in the inside of this section. The previously described annular or radially opened opening forming the entry opening of the impeller can lie in this cylindrical section. The cylindrical section of the impeller permits an axial movement of the impeller in a pump assembly, as has been described beforehand, wherein the entry region or the entry opening can be adequately sealed to the outside in each position of the impeller, in order to separate the pressure side and the suction side of the impeller from one another in every position.

The invention is hereinafter described by way of example and by way of the attached Figures.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
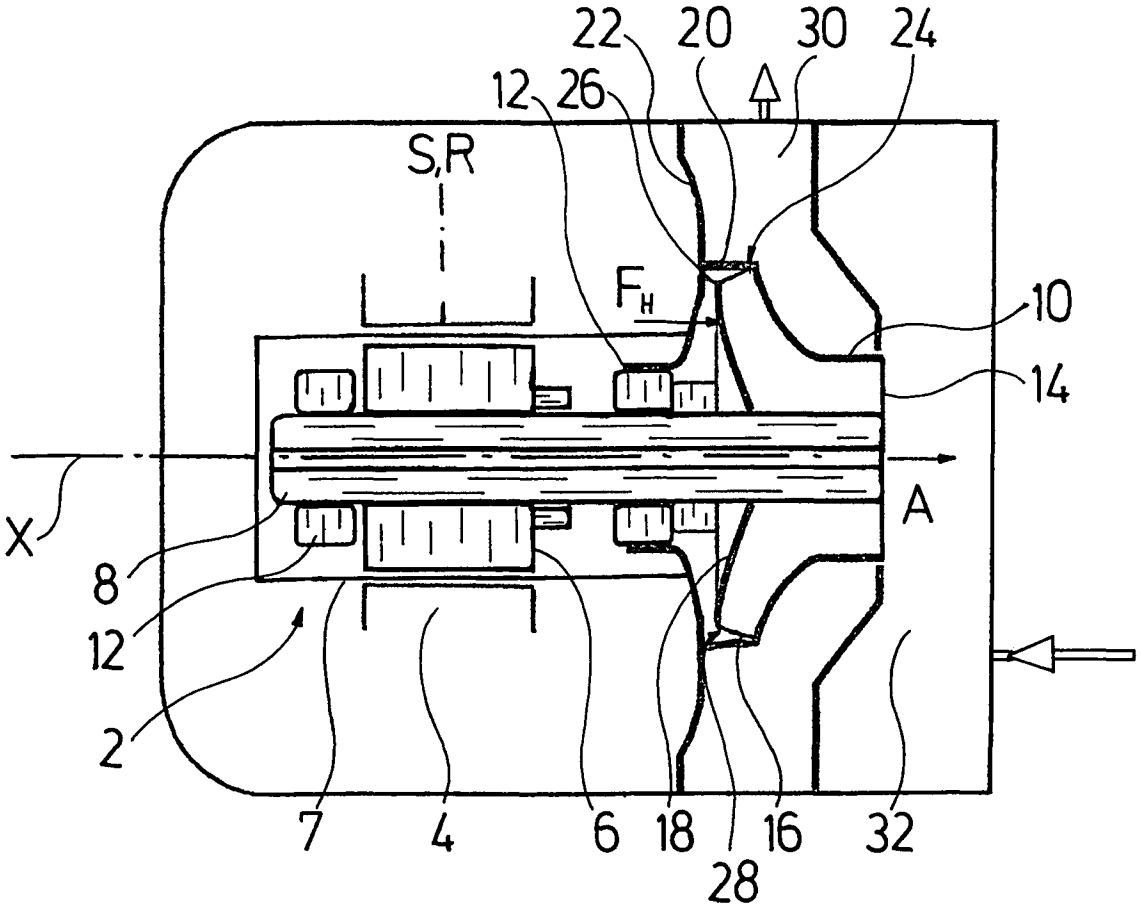
FIG. 1 is a schematic view of the first embodiment of the invention, with the impeller in a first functional position.
Figure 2:
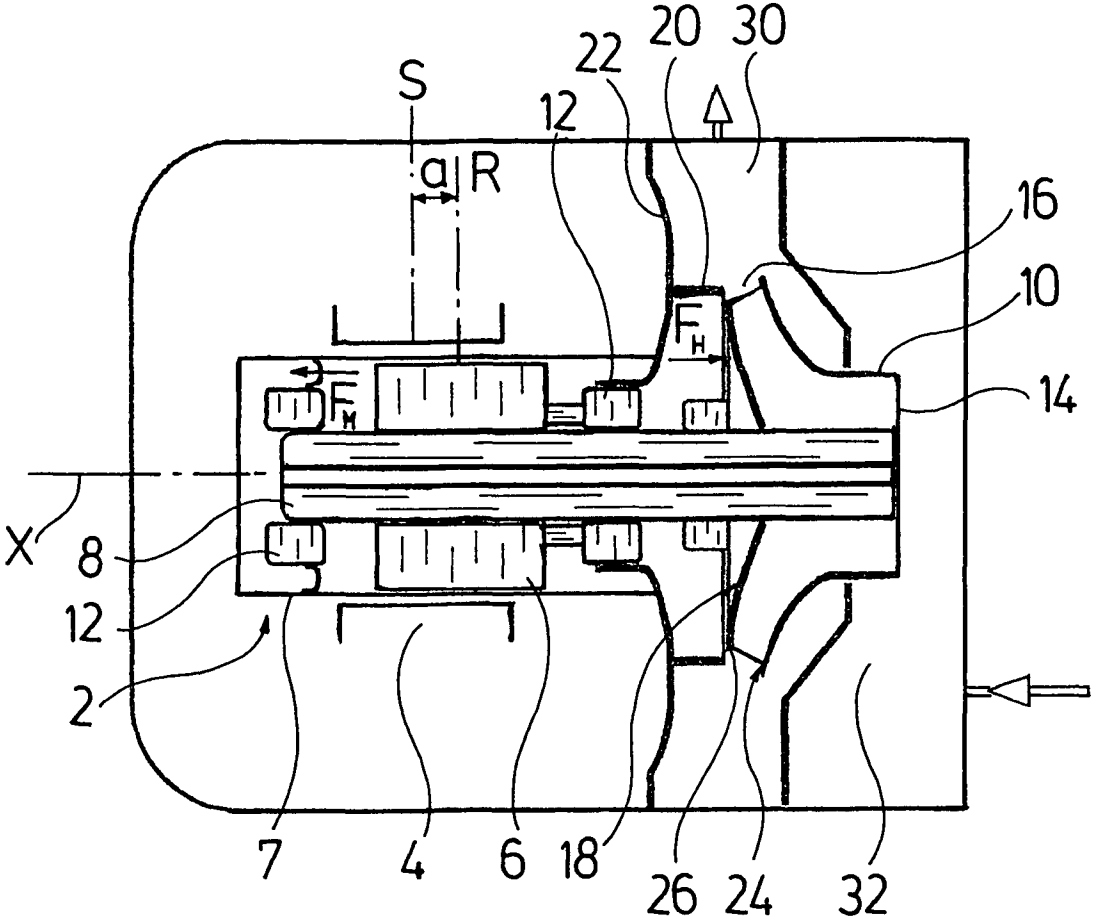
FIG. 2 is a schematic view of a centrifugal pump assembly according to FIG. 1, with the impeller in a section functional position.

The pump assembly according to the first embodiment in FIGS. 1 and 2 comprises an electric motor 2 which comprises a stator 4 as well as a rotor 6 which is rotatable therein about the longitudinal axis X. The drive motor is designed as a wet-running motor and comprises a can 7 between the stator 4 and the rotor 6. This can be designed in a completely closed manner and separates the rotor space and stator space. The rotor is designed as a permanent magnet rotor 6 and is connected in a rotationally fixed manner to a shaft 8 which extends along the longitudinal axis, is preferably manufactured of ceramic and is machined to bearing quality over it whole length. The shaft in turn is connected in a rotationally fixed manner to an impeller 10 which is preferably formed of plastic. The rotor 6 together with the shaft 8 and the impeller 10 is arranged in its bearings 12 in an axially movable manner, so that the impeller can assume a first axial functional position shown in FIG. 1 and a second axially distanced functional position shown in FIG. 2. Thereby, the impeller in the first functional position lies closer to the stator 4 than in the second functional position.

The impeller 10 at its second axial face side comprises an entry opening 14 in the form of a suction port. A fluid to be delivered, in particular a liquid to be delivered in the axial direction X can flow through this into the impeller 10. The flow is then accelerated radially outwards in the impeller 10 due to the centrifugal forces prevailing on rotation of the impeller, and can exit out of the impeller 10 through a peripheral exit opening situated at the axial end which is away from the entry opening 14. The exit opening 16 is designed as an annular opening in the peripheral region of the impeller in a manner adjacent a pressure-side, axial face side 18 of the impeller.

In the first functional position shown in FIG. 1, the exit opening 16 is closed by a closure element in the form of an annular wall 20. The annular wall 20, departing from a wall delimiting the pump space, in this case from a bearing carrier 22, extends in a direction away from the stator 4. Thereby, the annular wall 20 has such an axial length that in the first functional position it completely covers the axial extension of the exit opening 16 and comes into bearing contact with a first peripheral edge 24 delimiting the exit opening 16, on an axial side. The first peripheral edge 24 is thereby the peripheral edge which faces the suction side of the impeller 10 and which delimits the exit opening 16. The opposite second peripheral edge 26 which delimits the exit opening 16 to the pressure-side axial end and which is situated closer to the pressure side has a smaller diameter than the first peripheral edge 24 with respect to the longitudinal axis X and in the first functional position lies in the inside of the annular wall 24 in a manner such that an annular gap 28 remains between the inner periphery of the annular wall 24 and the second peripheral edge 26. The annular gap 28 forms a flow passage out of the inside of the impeller through the exit opening 16 to the pressure-side face side 18 of the impeller 10. This flow path is also open when the annular wall 20 bears on the first peripheral edge 24 and thus closes the flow path through the impeller to the outside into a pressure channel 30. Thus, although in the first functional position no fluid can flow out of the suction channel 32 into the pressure channel 30, however, if the impeller is rotated by way of the drive of the drive motor 2, it can flow into the space in the inside of the annular wall 20 adjacent to the pressure-side face side 18 or pressure-side shroud of the impeller 10. Thus, on starting up the impeller from the first functional position which is shown in FIG. 1, a pressure and a hydraulic axial force $F_H$ is produced in this region, said axial force acting parallel to the longitudinal axis X onto the pressure-side face side 18 of the impeller 10 and thus displacing the impeller 10 in the direction A into the second functional position shown in FIG. 2.

In this second functional position, the exit opening 16 lies displaced in the axial direction outside the annular wall 20, i.e. the peripheral edge 24 has disengaged from the face edge of the annular wall 20, and the annular wall 20 essentially no longer overlaps the annular exit opening 16, so that on rotation, fluid delivered by the impeller 10 can flow out of the exit opening 16 into the pressure channel 30. Thereby, the hydraulic force $F_H$ continues to act on the pressure-side face side 18 of the impeller 10 due to the pressure in the pressure channel 30. This hydraulic pressure $F_H$ holds the impeller 10 in the second functional position shown in FIG. 2.

In the first functional position, as is shown in FIG. 1, the rotor 6 is centered in the axial direction X with respect to the surrounding stator 4, i.e. the axial middle S of the stator and the axial middle R of the rotor lie essentially above one another. If the rotor, as is shown in FIG. 2, is displaced with respect to the stator 4 by the amount a, in order to bring the impeller 10 into the shown second functional position, the axial middle R of the rotor 6 thereby likewise displaces by the amount a with respect to the axial middle S of the stator 4, as is shown in FIG. 2. A magnetic restoring force $F_M$ results therefrom. With regard to this restoring force, it is the case of a permanent-magnetic force, since the rotor 6 is a permanent magnet rotor. The magnetic restoring force $F_M$ strives to move the rotor 6 back into the axially centered position shown in FIG. 1. I.e. the magnetic restoring force $F_M$ counteracts the hydraulic force $F_H$. The impeller 10 remains in the second functional position shown in FIG. 2, as long as the hydraulic force $F_H$ is greater than this magnetic restoring force $F_M$. This can be ensured by way of suitable dimensioning of the drive motor and the impeller 10. Moreover, the drive motor 2 can be controlled with a closed loop such that an adequate pressure in the pressure channel 30 is always ensured, in order to hold the impeller 10 in the shown second function position in operation. If the drive motor 2 is switched off, the hydraulic axial force $F_H$ falls away and only the magnetic restoring force $F_M$ continues to act, by which means the impeller 10 then via the shaft 8 together with the rotor 6 is moved back into the initial position which is shown in FIG. 1 and in which the impeller 10 is then located in the first functional position, in which the exit opening 16 is closed by the annular wall 20.

An automatic mechanical quantity limitation can be achieved if the drive motor is not regulated or controlled with a closed loop, such that the pressure in the pressure channel 30 is always such that the impeller in operation is held in its second functional position shown in FIG. 2. If the pump assembly gets into an operational condition with a high flow and low pressure, this then leads to the pressure in the pressure channel 30 dropping to such an extent that the hydraulic force $F_H$ becomes smaller than the magnetic restoring force $F_M$, and the impeller 10 moving in the direction of its first functional position which is shown in FIG. 1. Thereby, the exit opening 16 of the impeller is then at least partly closed, so that the flow through the impeller is reduced. Thereby, a pressure which counteracts the magnetic restoring force $F_M$ and which holds the impeller 10 in its second functional position or in a functional position between the first and the second functional position can thereby establish itself in the pressure channel 30 at the exit side of the impeller. Such a design is advantageous if the pump assembly has no electronic quantity limitation and for example cannot be activated from the outside, in order to reduce the flow quantity in certain operating conditions.

Figure 3:
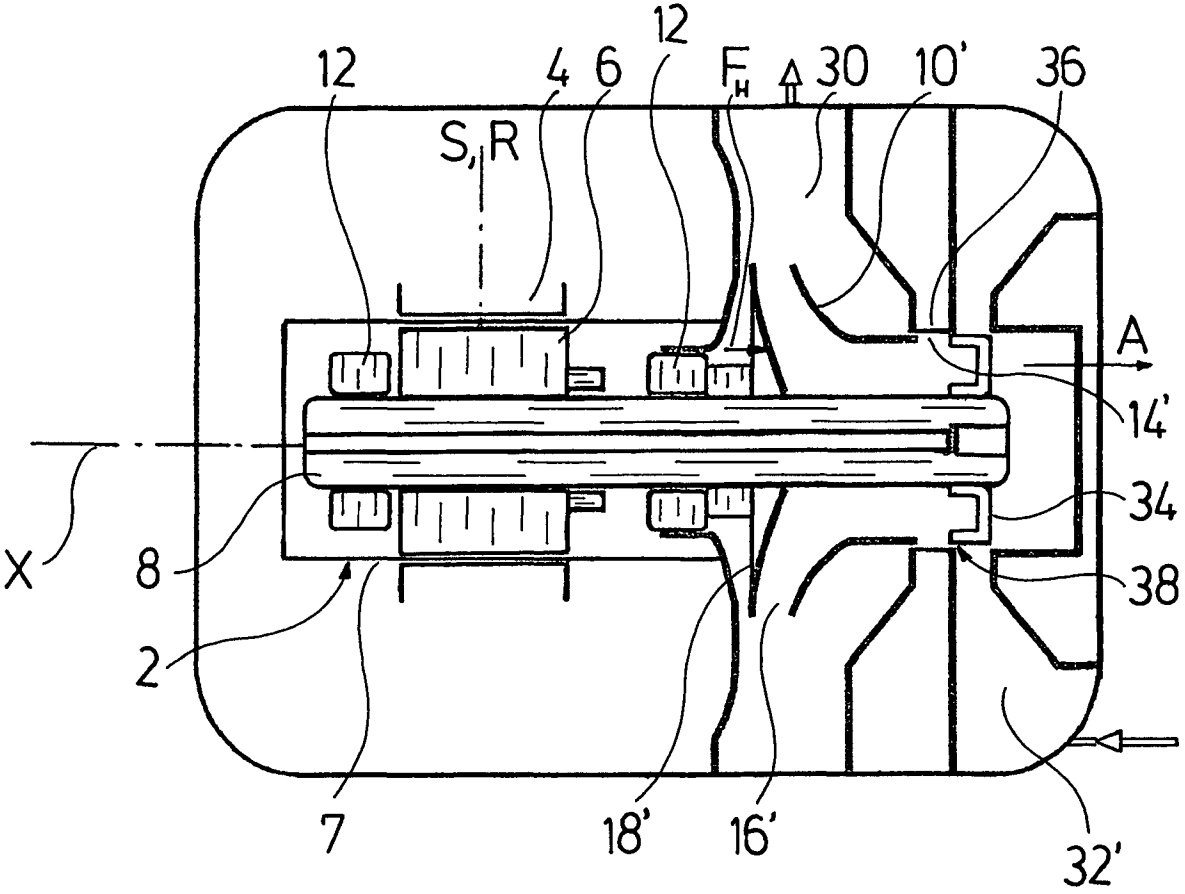
FIG. 3 is a schematic view of a second embodiment of a centrifugal pump assembly according to the invention, with the impeller in a first functional position.
Figure 4:
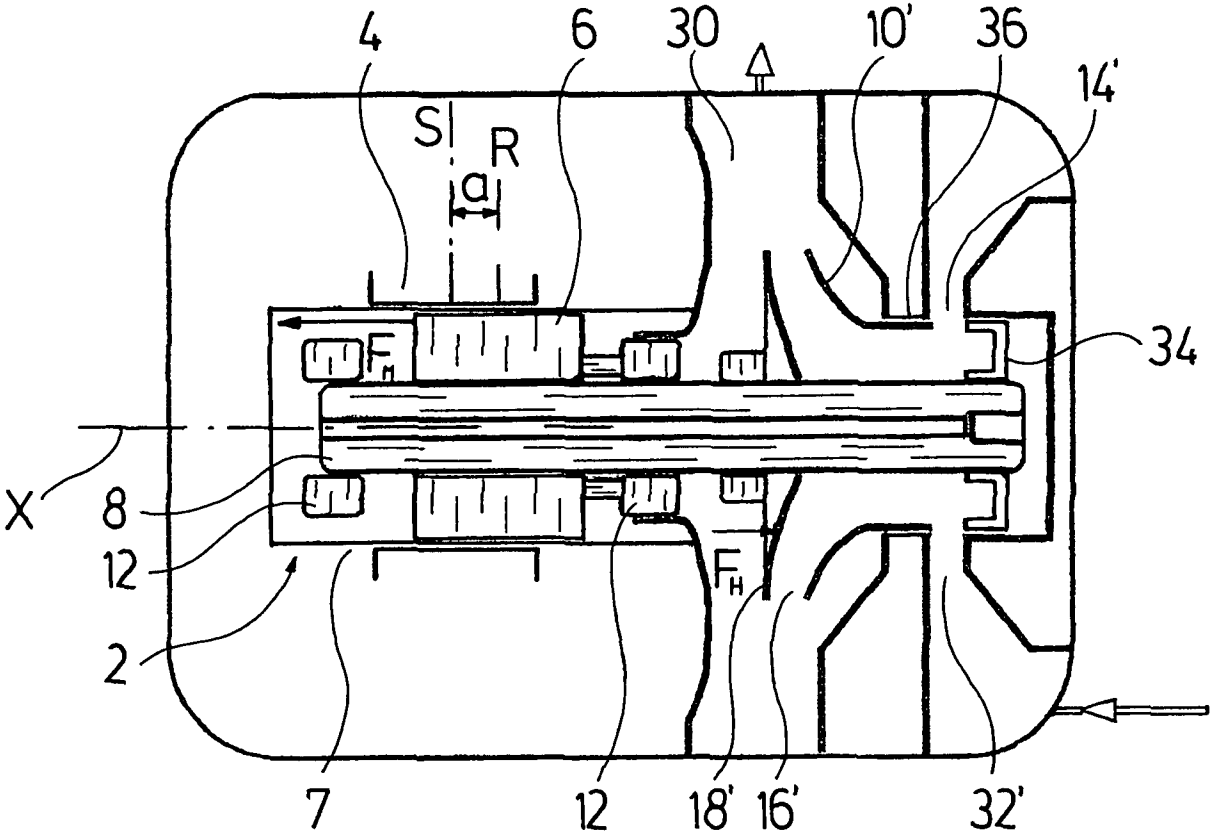
FIG. 4 is a schematic view of the centrifugal pump assembly according to FIG. 3 with the impeller in an impeller second functional position.

FIGS. 3 and 4 show a second embodiment of the invention. With regard to the centrifugal pump assembly shown in FIGS. 3 and 4, the drive motor 2 is designed identically to the embodiment example shown in FIGS. 1 and 2, so that the description concerning this is referred to. This drive motor 2 is also designed such that the axial middle of the rotor 6 comes out of overlap with the axial middle S of the stator 4 by way of displacing the rotor 6 relative to the stator 4 by the amount a, so that a magnetic restoring force $F_M$ results, as has been described with regard to the first embodiment example.

The second embodiment example differs from the first embodiment example in that in the first functional position it is not the exit opening 16' which is closed by the impeller 10' connected to the shaft 8, but the exit opening 14'. According to this embodiment, the exit opening 16' in both functional positions remains in fluid-leading connection with the pressure channel 30. However, in the first functional position which is shown in FIG. 3, the connection between the suction channel 32' and the exit opening 14' is essentially closed.

The entry opening 14' with this impeller 10' according to the invention is designed as a peripheral-side or radial-side entry opening 14'. The entry opening 14' forms a peripheral, annular opening, through which fluid can enter in the radial direction into the inside of the impeller 10'. The suction-side face side 34 of the impeller 10' is designed in a closed manner. The suction-side face side 34 is formed by a disk-like wall which simultaneously can assume the function of a cam disk, since a hydraulic force can act on both sides of the suction-side face side 34, i.e. the surface facing the inside of the impeller as well as the outwardly directed surface. In a first functional position, the entry opening 14' lies such that it lies opposite an annular wall 36 in the pump space or pump housing. The annular wall 38 is designed concentrically to the longitudinal axis X and encompasses the annular entry opening 14' such that this is essentially completely covered. Thereby, the inner diameter of the wall 36 however is slightly larger than the outer diameter of the peripheral surfaces adjacent the opening 14', so that an annular gap 38 remains between the wall 16' and the peripheral edge delimiting the entry opening 14'. This gap forms a residual opening if the flow path through the impeller 10' is essentially closed in the first functional position. The residual opening however represents less than 2% of the area of the entry opening 14', so that only a very small flow passage remains. The flow passage through the gap 38 is dimensioned such that here, only just so much fluid or liquid can flow through in the first function position according to FIG. 3, that a pressure can build up in the pressure channel 30 on starting the impeller 10'. Such a pressure leads to a hydraulic axial force $F_H$ which acts on the pressure-side shroud or face side 18' from the outside, on the impeller 10', so that this impeller is displaced in the direction A from the first function position into the second functional position shown in FIG. 4.

In this second functional position, the entry opening 14' lies opposite the suction channel 32, so that the suction channel 32' by way of the entry opening 14' is in fluid-leading connection with the inside of the impeller 10', and the impeller 10' delivers fluid or liquid in the usual manner on rotation. Thereby, the hydraulic axial force $F_H$ continues to act on the pressure-side shroud or face side 18', so that with a sufficient pressure in the pressure channel 30, the impeller 10' is held in this second functional position against the magnetic restoring force $F_M$. Preferably, the drive motor 2 is controlled with a closed loop such that a sufficient exit-side pressure is always ensured in the pressure channel 30. If the drive motor 2 is switched off, and the impeller 10' thus no longer delivers fluid, the hydraulic axial force $F_H$ drops off and the impeller 10' is moved via the shaft 8 together with the rotor 6 by way of the magnetic restoring force $F_M$ back into the first functional position shown in FIG. 3.

In the previously described examples, the first functional position is that in which the flow path through the impeller is closed. However, it is to be understood that the impeller and the drive motor without further ado can also be designed such that the second functional position is that in which the flow path is closed. This could be achieved by an offset between the stator and rotor in the reverse direction and by way of the use of a pressure-relieved impeller, with which the pressure-side face side of the impeller is impinged with the suction-side pressure.

While specific embodiments of the invention have been shown and described in detail to illustrate the application of the principles of the invention, it will be understood that the invention may be embodied otherwise without departing from such principles.

The invention claimed is:

1. A centrifugal pump assembly comprising:

an electric drive motor;

at least one impeller movable in an axial direction between at least two functional positions, wherein in one functional position a flow path through the impeller is essentially closed and in another functional position the flow path through the impeller is opened, wherein the impeller in a first functional position is held by a permanent magnetic force resulting from an axial offset of the permanent magnet rotor relative to the stator of the drive motor and the at least one impeller is held in a second functional position by a hydraulic force produced by a delivered fluid, wherein the hydraulic force is greater than the permanent magnetic force holding the at least one impeller in the first functional position and the hydraulic force is increased if the drive motor is switched on and the hydraulic force decreases if the drive motor is switched off.

2. A centrifugal pump assembly according to claim 1, wherein the permanent magnetic force acts between a permanent magnet rotor connected to the impeller, and the surrounding stator of the electric drive motor.

3. A centrifugal pump assembly according to claim 1, wherein the flow path through the impeller is closed in the first functional position.

4. A centrifugal pump assembly according to claim 1, wherein the flow path through the impeller is closed in the second functional position.

5. A centrifugal pump assembly according to claim 1, further comprising a closure element, wherein in one of the functional positions the flow path through the impeller is closed, and said one of the functional positions the closure element closes an exit opening or an entry opening of the impeller at least for the larger part.

6. A centrifugal pump assembly according to claim 5, wherein the closure element in that functional position, in which the flow path through the impeller is closed, closes the entry opening or the exit opening for the larger part, but closes it only to the extent that a pressure build-up on the exit side of the impeller is possible on starting the impeller.

7. A centrifugal pump according to claim 5, wherein the impeller is movable relative to the closure element between the first and the second functional position.

8. A centrifugal pump assembly according to claim 5, wherein the impeller comprises an axial-side or radial-side entry opening and the closure element covers the entry opening in one functional position.

9. A centrifugal pump assembly according claim 5, wherein the impeller comprises a radial-side exit opening, and the closure element covers the exit opening in one functional position.

10. A centrifugal pump assembly according to claim 9, wherein the closure element is designed as an annular wall which peripherally surrounds the exit opening in one functional position.

11. A centrifugal pump assembly according to claim 10, wherein in the one of the functional position, in which the flow path through the impeller is closed, the impeller bears with a first peripheral edge delimiting the exit opening, on a face edge of the annular wall.

12. A centrifugal pump assembly according to claim 11, wherein in the one of the in that functional position, in which the flow path through the impeller is closed, a flow path open to an axial face side of the impeller remains between a second peripheral edge lying opposite the first peripheral edge, and the annular wall.

13. A centrifugal pump assembly according to claim 1, further comprising a closure element, wherein in one of the functional positions the flow path through the impeller is closed, and said one of the functional positions the closure element closes an exit opening or an entry opening of the impeller at least for the larger part by more than 90%.

14. An impeller for a centrifugal pump, the impeller comprising:

a first peripheral impeller edge surface;

a second peripheral impeller edge surface;

at least one exit opening; and at least one entry opening defined by the first peripheral impeller edge surface and the second peripheral impeller edge surface, wherein the entry opening is situated in a peripheral section of the impeller, the first peripheral impeller edge surface being configured to be in direct contact with an annular wall when the impeller is in a first functional position, the second peripheral impeller edge surface being configured to be located at a spaced location from the annular wall to define a gap between an inner edge surface of the annular wall and the second peripheral impeller edge surface when the impeller is in the first functional position, wherein the impeller is held by a magnetic force in the first functional position and the impeller is held by a hydraulic force produced by a delivered fluid in a second functional position, wherein the hydraulic force is greater than the permanent magnetic force holding the at least one impeller in the first functional position and the hydraulic force is increased if the drive motor is switched on and the hydraulic force decreases if the drive motor is switched off.

15. An impeller according to claim 14, further comprising a closed, suction-side, axial face side, to which the peripheral section with the entry opening is adjacent, the first peripheral impeller edge surface comprising a first diameter, the second peripheral impeller edge surface comprising a second diameter, the second diameter being less than the first diameter.

16. An impeller according to claim 15, wherein the entry opening is configured as an annular opening extending over the complete periphery of the impeller.

17. An impeller according to claim 16, wherein the impeller has a suction side comprising a lengthened cylindrical section which has an outer surface which is 50 to 150% of an inner cross section in an inside of the lengthened cylindrical section.

18. A centrifugal pump assembly comprising:

an electric drive motor;

a closure element comprising a closure element inner surface, the closure element inner surface being parallel to a longitudinal axis of the closure element;

an impeller movable in an axial direction between at least a first functional position and a second functional position, wherein in the first functional position a flow path through the impeller is essentially closed and in the second functional position the flow path through the impeller is opened, wherein the impeller in a first functional position is held by a magnetic force and in a second functional position is held by a hydraulic force produced by a delivered fluid, wherein the impeller is moved from the first functional position to the second functional position via the hydraulic force when the hydraulic force is greater than the magnetic force, wherein the hydraulic force increases when the electric drive motor is switched to an actuated state and the hydraulic force decreases when the electric drive motor is switched to a non-actuated state, the impeller having a first impeller peripheral surface portion and a second impeller peripheral surface portion, the first impeller peripheral surface portion being in contact with the closure element inner surface when the impeller is in the first functional position, the second impeller peripheral surface portion being located at a spaced location from the closure element to define a gap between the closure element inner surface and the second impeller peripheral surface portion, the first impeller peripheral surface portion and the second impeller peripheral surface portion being located at a spaced location from the closure element when the impeller is in second functional position.

19. A centrifugal pump assembly according to claim 18, wherein the magnetic force results from an axial offset of the permanent magnet rotor relative to the stator of the drive motor.

20. A centrifugal pump assembly according to claim 19, wherein the permanent magnet rotor is axially offset from the stator when the impeller is in the second functional position, the permanent magnet rotor being axially aligned with the stator when the impeller is in the first functional position.

* * * * *